United States Patent [19]

Babington

[11] 4,155,700

[45] May 22, 1979

[54] LIQUID FUEL BURNERS

[76] Inventor: Robert S. Babington, 1113 Ingleside Ave., McLean, Va. 22101

[21] Appl. No.: 755,938

[22] Filed: Dec. 30, 1976

[51] Int. Cl.[2] ..... F23D 15/04

[52] U.S. Cl. ..... 431/117; 431/351; 431/352; 239/434; 239/543

[58] Field of Search ..... 431/285, 351, 352, 117, 431/118; 60/39.65; 239/426, 543, 125, 434

[56] References Cited

U.S. PATENT DOCUMENTS

| | | | |
|---|---|---|---|
| 1,577,114 | 3/1926 | De Walt | 239/543 |
| 1,910,615 | 5/1933 | Laney | 431/117 |
| 3,067,582 | 12/1962 | Schirmer | 60/39.65 |
| 3,425,058 | 1/1969 | Babington | 431/117 |
| 3,539,102 | 11/1970 | Lang | 239/434 |
| 3,595,482 | 7/1971 | Loveday | 239/434 |
| 3,923,251 | 12/1975 | Flournoy | 431/351 |
| 4,035,137 | 7/1977 | Avand | 431/351 |
| 4,036,582 | 7/1977 | Fehler et al. | 431/352 |

*Primary Examiner*—Henry C. Yuen

*Attorney, Agent, or Firm*—Pollock, Vande Sande & Priddy

[57] ABSTRACT

An improved fuel burner particularly adapted for domestic use and capable of burning fuels such as fuel oil and the like with extremely high efficiency and low pollutant output is comprised of a pair of identical spray heads, each including a spherical plenum onto which the fuel is flowed for atomization, the spray heads being disposed at the end of a flame tube which in turn is located within a blast tube, said spray heads further being disposed symmetrically with respect to the axis of both the flame tube and the blast tube and angularly disposed relative to each other whereby the spray output from the spray heads creates a turbulence within the flame tube such that the propagation of the flame front within the tube can be readily controlled and whereby the fuel may be readily ignited by a spark type of ignitor which is disposed centrally between the spray heads. The plenum is provided with one or more apertures through which atomizing gas is passed to generate the spray, and air access ports are so located in the flame tube such that substantially complete combustion of the fuel is effected.

33 Claims, 5 Drawing Figures

LIQUID FUEL BURNERS

PRIOR ART AND BACKGROUND

As is well recognized in the industry, there has long been a need to develop and to provide a fuel burning system which is capable of burning a liquid fuel in a very efficient manner and without the side effects of inadequate combustion which lead to the omission of pollutants into the atmosphere.

In the case of residential oil burners, the burner must operate with low smoke emissions to prevent sooting of the heat exchanger and objectionably high smoke levels in residential neighborhoods. The result is that large amounts of excess air must be introduced in the residential combustion process to assure that the burner operates at acceptable smoke levels.

It is well known that conventional oil burners burn very differently when they are placed in different type furnaces. This is because of the poor fuel atomization of current high pressure oil burners, which when installed in a furnace, cause some of the oil particles that discharge from the nozzle to be very large. These large particles take time to vaporize and burn and may therefore, fall to the bottom of the combustion chamber without burning. When the combustion chamber is cold, these large particles form a puddle in the bottom of the combustion chamber. When the combustion chamber is heated, these large droplets or, in some cases, puddles of fuel, eventually vaporize and burn.

There will be more or less puddling or spattering of large particles on the walls of the combustion chamber, depending upon the particular combustion chamber design and the temperature within the firebox. As a result, the combustion chamber or firebox, in a normal home furnace, acts as an afterburner to burn large particles of fuel because the atomization system in a conventional gun burner cannot by itself adequately atomize the fuel.

An oil burner may be 2–3 times larger than is necessary to provide adequate space heating when it is intended that the same burner shall be used to provide hot water in addition to space heating. When outside temperatures are low and hot water demands are high, the burner must be able to satisfy both of these requirements when the demands are at a peak. However, when the demand for heat is low, as in the spring and fall months, and hot water demands are at a minimum, as would be the case at night, the burner still operates at the same firing rate as it does when heating and hot water demands are high. The only difference is that when the requirements are low, the burner may only stay on for quite short period. This is an inefficient mode of operation since, under these conditions the burner cycles on and off many times so that fuel economy is very low. During this short on cycle with such a burner, the burner cannot achieve smokeless operation, and reasonable efficiency, before the thermostat cuts it off. During "off" cycle, much of the residual heat in the furnace is dissipated to the atmosphere and contributes to increased fuel costs.

An innovative approach to fuel burners is illustrated in U.S. Pat. No. 3,425,058, issued Jan. 28, 1969, to Robert S. Babington. The burner therein disclosed represents an adaptation of the liquid atomization principles disclosed in U.S. Pat. Nos. 3,421,699 and 3,421,692 issued Jan. 14, 1969, to the same named inventor and his co-inventors in developing the apparatus and method shown in these patents.

In brief, the principle involved in the aforementioned patents is that of causing a liquid to be atomized to flow over a surface in a highly stressed state, either due to surface tension or due to the particular configuration given to the surface upon which the liquid is discharged.

The surface upon which the liquid is flowed is generally the outside of a plenum chamber having one or more very small apertures over which the liquid flows in a continuous film. Air is introduced into the plenum and passes through the aperture and thereby causes a phenomena in the film whereby very fine micro-sized particles of the liquid are caused to separate from the film in substantial numbers.

By such variations as increasing the number of apertures, the configuration given the apertures, the characteristics of the surface, the regulation of the liquid flow, and/or the regulation of the air pressure, it has been found that not only can great numbers of micro-sized particles be generated but they can be generated in such density that it is impossible to penetrate the resulting spray with light.

It is this basic principle, described above, that was utilized in the development of the very burner disclosed in said U.S. Pat. No. 3,425,058.

In the above-mentioned patent, the developmental burner comprised of simply a cylindrical chamber having a cover thereover, the cover being provided with an aperture adapted to discharge spray generally vertically from the chamber. Disposed within the chamber is a spherical plenum having a lower cone-shaped appendage, the chamber being in communication with a source of air. Liquid is introduced into the chamber so as to flow over the surface of the sphere and drain downwardly along the appendage to a funnel disposed beneath the appendage. The fluid not expended in the combustion process is then discharged back to a sump for recirculation into the liquid system. The plenum is provided with a small aperture centrally located beneath the opening in the cover and the air exiting therefrom creates a fine mist which is discharged upwardly and out of the container for mingling with the atmosphere and combustion occurs at that point.

Means comprising a series of regulatable apertures are also provided in the container below the sphere such that aspirated air can be drawn into the chamber and mingled with the spray as it discharges from the top opening.

From this very simple version of a fuel burner was derived more sophisticated equipment, such as that shown and discussed in an article in the January 1976 issue of *Popular Science;* entitled "Clog-Proof Super Spray Oil Burner". As noted in the article, one development that evolved was the use of two atomizing heads arranged to discharge the atomized liquids toward one another to create a very high concentration of atomized liquid at a fixed point at which is disposed an ignitor to initiate the combustion process.

A similar arrangement of opposed spray heads is also suggested in U.S. Pat. No. 3,864,326, dated Feb. 2, 1975.

All of the above noted developmental work based on the utilization of the "Babington" principle proved conclusively that the system was perfectly capable of use in a fuel burning system and that, if properly designed, such a system has the potential of evolving into a commercial, practical, highly efficient fuel burner which can be used for domestic heating furnaces. This invention, then, deals with a novel fuel burner, particularly adapted for use in practically every type of domestic heating furnace and in particular, as a retrofit burner for existing heating systems. Grade or fuel oil can be burned with 95% efficiency and at a zero smoke factor within thirty seconds or less from the time of ignition.

SUMMARY OF THE INVENTION

The present invention, the inefficiencies associated with many on-off burner cycles are eliminated. By simply controlling the liquid film thicknesses over the atomizing surfaces as will be described, the firing rate of the burner can be modulated over a typical range of 5-1. This means that the same burner, without changing atomizers, can be modulated either manually or automatically to match the heating and/or hot water loads. For example, during modestly cool spring and summer evenings, the burner can be set to operate at a firing rate of 0.3 gal/hr. and during cold winter days when hot water is required, the same burner can be adjusted to consume fuel at a rate of 1.5 gal/hr. These adjustments can be made manually by simply adjusting the fuel flow rate over the atomizing spheres by means of a simple valve in the liquid feed line, and by making a corresponding adjustment to the combustion air delivered to the flame tube. In the most sophisticated version of the novel burner disclosed herein, these adjustments can be made automatically with suitable control techniques readily available on the market.

Another object of the present invention is to produce an oil burner whose firing rate can be simply modulated either manually or automatically to suit the heating demand.

Another object of the invention is to produce a burner that performs with high efficiency regardless of the combustion chamber that it is placed into and therefore is ideally suited as a retrofit or replacement burner for existing furnaces.

Still another object of this invention is to produce a oil burner that will permit substantial reductions in energy costs when retrofitted into existing furnaces.

Still another object of this invention is to produce an oil burner with exceptionally stable flame front.

Another object of the invention is to produce a burner that is capable of operating at low firing rates, as for example less than 0.5 gal/hr. without clogging problems.

The burner of this invention comprises a cylindrical blast tube housing concentrically therein a flame tube to define an annular air passage therebetween said passage being closed at one end by an annular plate; the opposite end of said passage being closed by a second annular plate having apertures therein, said flame tube being open at said first mentioned end and being provided with a perforated closure having a large central aperture at the second mentioned end; atomizing heads being provided to discharge through said perforated closure, said flame tube having apertures therein located at relative angular positions to stage air into the flame tube to control the shape of the emitted flame.

BRIEF DESCRIPTION OF THE DRAWINGS

Reference is now made to the appended drawings and the detailed description which follows, showing one preferred mode of practicing the invention.

DETAILED DESCRIPTION OF THE PREFERRED EMBODIMENT

Figure 4:
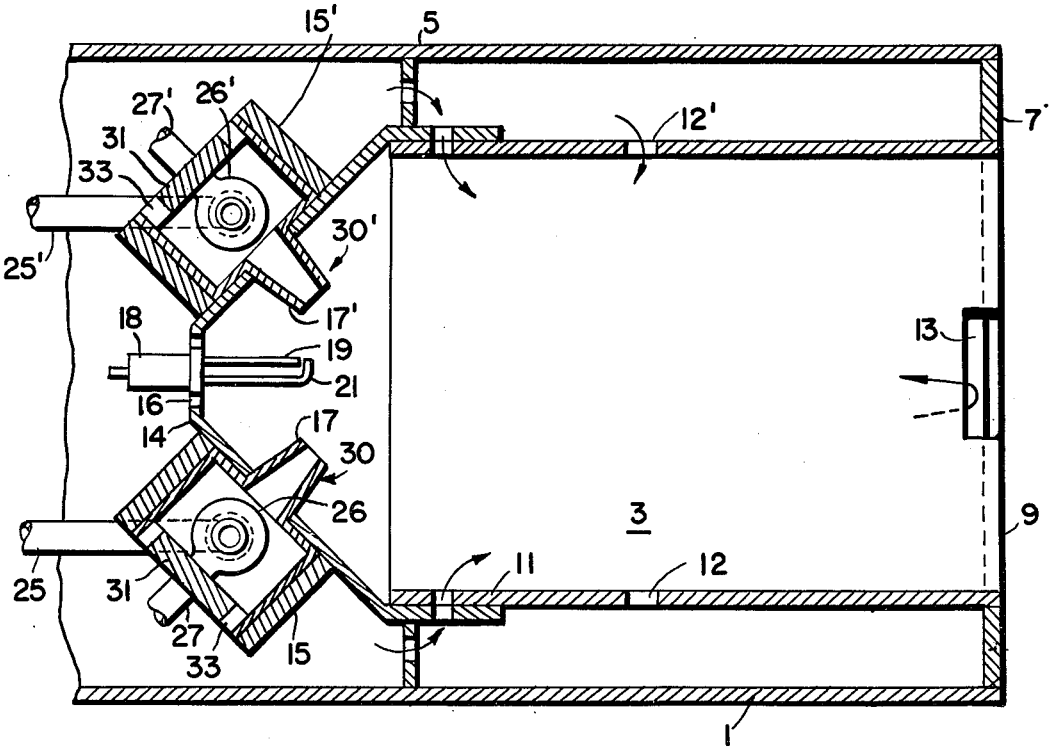
FIG. 4 is a sectional plan view taken approximately along the line 4—4 of FIG. 2 and showing details of the flame tube assembly.

Deferring descriptions of FIGS. 1A and 1B momentarily, consideration will first be given to FIGS. 2 and 4 which show the improved fuel burning assembly. As shown in FIG. 4, a conventional blast tube 1, which is essentially an elongated open ended pipe disposed in the firebox of the furnace, supports concentrically therein a flame tube 3 supported on a plurality of annular rings 5 and 7 such that the flame tube 3 is located concentrically with respect to the blast tube to define an annular air passage therebetween. The flame tube 3 is open at both ends, one end 9 facing 1 toward the firebox of the furnace or the like, the other end facing toward the exterior of the firebox and upon which the spray heads are mounted and, as is also the oil and air supply motors and compressors carried in a suitable housing.

The open end 9 of the flame tube 3 is provided with a pair of cutouts 13, 13', the function of which will become apparent subsequently. Similarly the flame tube is provided with a further pair of apertures 12, 12' located approximately midway of its length. These apertures are disposed at 90° relative to the cutouts 13, 13'.

The cylindrical flame tube 3 is provided at its opposite end 11 with a pair of spray heads 30 and 30' which are defined by cuplike atomizing chambers 15, 15', respectively.

The atomizing heads are supported upon a foraminous fire wall 14, which is shown as being generally cone shaped, said wall being provided with a relatively large central aperture 16 passing through the wall 14 at its center.

Projecting through the central opening 16 in wall 14 and disposed midway between the atomizing heads 30, 30' is a conventional spark igniter 18 which includes a pair of discharge electrodes 19 and 21. The igniter may be supported by a suitable bracket and, of course, is energized from a source of high voltage electricity.

Figure 3:
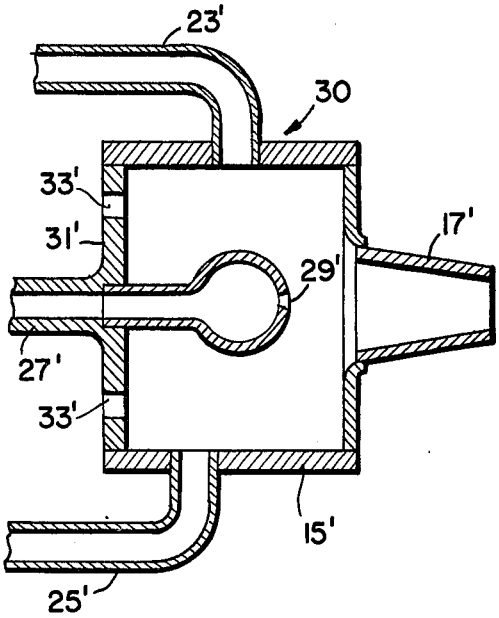
FIG. 3 is a vertical section view taken along the line 3—3 of FIG. 2 and showing details of one of the spray heads.

As shown in FIGS. 3 and 4, the chambers 15, and 15' respectively, may be provided with discharge cones 17 and 17' which discharge atomized fuel inwardly into the flame tube 3.

FIG. 3 shows that each atomizing chamber 11 is provided with a pair of conduits 23' and 25' which are, in essence, elbows having one end projecting into the chamber along a generally vertical plane passing immediately through the walls thereof. The uppermost conduit 23' defines a fuel supply conduit while the lower conduit 25' defines a drain-off conduit, the functions of both of which will be apparent subsequently.

Disposed directly below each fuel supply conduit 23' and supported on the rear wall 31' of the chamber 15' is a spherical plenum chamber 26' which is supplied with air under pressure through conduit 27', which also extends through the rear wall 31' of the cup-shaped vaporizing chamber 15'. The plenum chambers 26, 26' is provided with at least one being small aperture 29', only one shown in FIG. 3, which is located so as to discharge air directly toward the discharge horn 17'.

As clearly shown in FIG. 3, the rear wall 31' of the vaporizing chamber 15' is provided with an aperture 33' whose function will be described in detail hereinafter.

Though not shown, it is to be understood that each inlet conduit 23' are connected to a source of liquid fuel by means of a pump, whereby the fuel may be pumped through these conduits and deposited on the spherical surfaces of the plenum chamber 26'. Similarly, the drain or discharge conduit 25' is connected to the fuel supply system so that liquid which is not atomized within these chambers can be returned to the fuel system not shown and recirculated therein.

The description given above with specific reference to spray head 30' of FIG. 3 applies in identical fashion to spray head 30 shown in FIG. 4.

MODE OF OPERATION AND COMPARATIVE DATA

Directing attention now particularly to FIGS. 3 and 4, the operation of the improvement in fuel burning heads is as follows.

Liquid fuel is introduced into the system by the conduits 23, 23'. The liquid fuel flows over the plenum chambers 26, 26' and a portion thereof is atomized by air under pressure which is introduced into the plenum through the conduit 27. Liquid which is not atomized flows to the bottom of the chambers 15, 15' and is withdrawn therefrom by conduits 25, 25' for recirculation in the fuel supply system.

As described above, the atomizing heads utilize the basic "Babington" liquid atomization system disclosed in prior mentioned U.S. Pat. Nos. 3,421,699 and 3,421,692.

Due to the discharge of air from the plenum chambers through apertures 29, there is created a venturi effect as the air fuel mixture projects outwardly and is discharged through discharge horns 17 and 17' where such horns are provided. In order to enhance this effect, air enters the ports 33, 33' and is drawn along with the atomized fuel into the flame tube 3. Combustion air is supplied through the aperture 16 in the foraminous fire wall 14 and provides combustion air so that the turbulent mixture that results when the two sprays from atomizers impinge beyond the horns will readily ignite when the igniter 18 is energized to cause a spark between electrodes 19 and 21.

Additional combustion air passes along the annular passage between flame tube 3 and blast tube 1 and is staged into the interior of the flame tube 3 through the staging ports 12 and the cutouts 13, 13'.

The unique configuration of the flame tube within a blast tube provides a unique heat exchanger in which combustion air for staging purposes passes through the annular area between the flame tube and the blast tube. In traversing this route, the combustion air picks up heat from the inner hot walls of the flame tube. This hot air, as it is delivered to the interior of the flame tube at the two aforementioned staging locations, helps to promote rapid vaporization of the atomized fuel to complete the combustion process downstream in the flame tube. The staging of combustion air in this manner allows the temperature within the flame tube to be maintained at the desired level to keep nitrous oxide emissions to a minimum.

Still another advantage of the manner in which the combustion air is staged is to produce a flame which, when emitted from the burner, is short and bushy. This is achieved by introducing said staged air in a non-symmetrical manner which is contrary to the fuel/air mixing technique used in conventional residential type oil burners. For example, at the first combustion air staging location, downstream from the spray impingement site, two air blast may be introduced perpendicular to the long axis of the blast tube, at 3 o'clock and 9 o'clock location. By subjecting the flame within the flame tube to a non-symmetrical air blast of this type, the flame is caused to squirt out and fill the flame tube at the 6 o'clock and 12 o'clock position. Furthermore, the low static pressure within the air blasts at the 3 and 9 o'clock positions causes the flame to wrap around the air blasts and thus produce a shorter and more compact flame which fills the entire flame tube. In the second combustion air staging location, two air blasts are introduced at the lip of the blast tube but this time the air blasts are introduced at the 12 o'clock and 6 o'clock positions. This causes the flame to spread out in the 3 o'clock and 9 o'clock position as it leaves the burner blast tube and enters the combustion chamber. A short bushy flame of this type is ideal for a retrofit or replacement burner, because it is suited for use in any type of combustion chamber. This is in contrast to a long thin flame which would impinge upon the back side of many combustion chambers and cause erosion of the combustion liner. At the same time, the combustion air passing between the flame tube and the blast tube serves to keep the outer blast tube cool, thereby preventing heat erosion of the blast tube. In the case of the present invention, the atomization system is so efficient, and the subsequent fuel/air mixing and vaporization is likewise carried out in such a highly efficient manner, that the burner does not require a hot combustion chamber to achieve high combustion performance. The present burner design has been utilized in a wide variety of different combustion chambers and has always been able to achieve smokeless operation, and flue-gas $CO_2$ levels between 14–14½%, when operating at a firing rate which is close to that of the furnace rating. Even when the present burner is set to operate at firing rates well below the furnace rating (e.g. burner operating at 0.5 gal/hr. in a 1.0 gal/hr. furnace) $CO_2$ levels with smokeless operation will normally never fall below 13%.

This is in contrast to the average conventional home oil burner that operates at $CO_2$ levels of 8% even when the burner firing rate is matched to the furnace capacity. These characteristics of total independence of furnace design and furnace temperature makes the present invention ideal as a replacement or retrofit burner. This non-dependence on furnace temperature also means that the present burner will achieve smokeless operation the instant ignition occurs and before the combustion chamber becomes hot. The typical conventional high pressure burner takes several minutes for the smoke level to drop to acceptable levels after ignition has occurred.

Another fact to be noted is that conventional high pressure nozzles have difficulty operating at firing rates below approximately 0.7 gal/hr. without encountering a high incidence of clogging. In the present burner, there is essentially no minimum firing rate that can be attained; a prototype burner has been operated at a firing rate of 0.5 gal/hr. This means that each individual atomizer is operating at approximately one-half that firing rate. Further, it is not necessary, in the present burner, that both atomizers be generating the same amount of fuel spray for the burner to operate efficiently. For example, one atomizer may have a firing rate of 0.3 gal/hr. while the other has a firing rate of 0.2 gal/hr. A burner of this type will operate just as efficiently as one in which each atomizer is delivering a spray rate of 0.25 gal/hr. This low firing rate capability of the present invention is very important in light of the present energy crisis because homes in the future will be built with better insulation and the trend is towards low firing burners that can provide highly efficient operation.

It should be noted that the perforations in the fire wall 14 are so numbered and sized that a very soft flow of air passes through this wall. This soft air flow tends to keep products of combustion from filtering or rolling back toward the spray heads and the igniter, thus inhibiting sooting of these elements.

The included angle between the atomizing heads 30, 30' is shown in FIG. 4 as being approximately 90°. This angle can be varied, however, and may be between 45° and 150°.

Figure 1A:
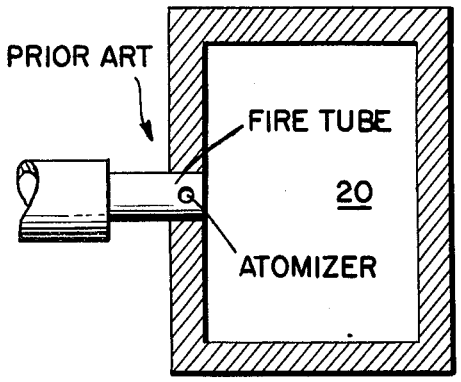
FIGS. 1A and 1B are a schematic view of a typical heating furnace or firebox and showing the utility of the present invention as compared to the usual prior art apparatus.
Figure 1B:
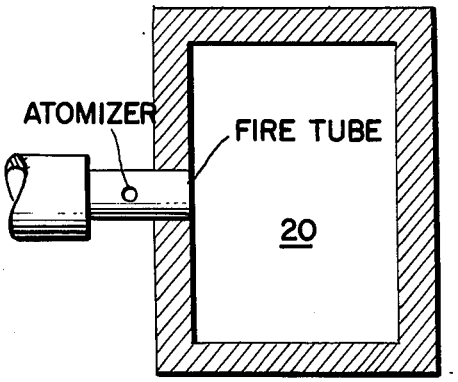
Figure 2:
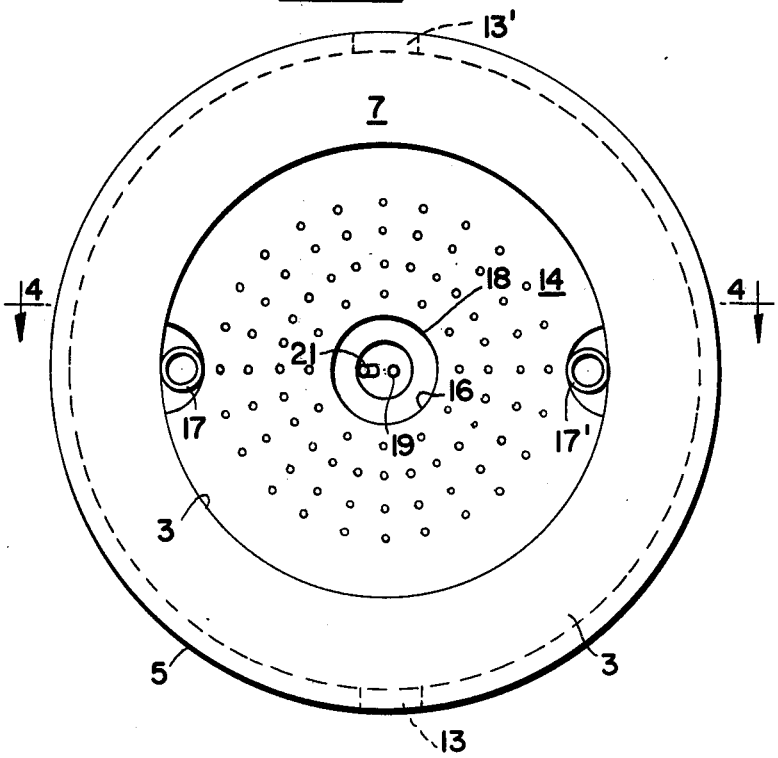
FIG. 2 is a front end view of a fuel burner assembly as utilized in the firebox referred to in FIG. 1.

Turning now to FIGS. 1 and 1A, it will be noted that in the prior art the atomizing nozzles are located close to the interior of the firebox. Consequently, the nozzles are subjected to high temperatures. Due to this fact, the nozzles are subject to varnish depositions and clogging are continually subject to soot and dirt and varnishing caused by decomposition of the fuel due to its exposure to the heated parts which results in a varnish deposit being laid down on the atomizing nozzles and those parts which are disposed within the firebox.

In contrast, utilizing applicant's improved fuel burning head, the atomizing heads are located well inwardly of the end of the blast tube and are thus not subjected to the radiant and convective heat of the firebox. Since the parts then remain virtually cool, there is little decomposition of the carbons in the fuel and hence there is little or substantially no varnishing to interfere with proper atomization of the fuel or operation of the atomizing parts.

Having described a preferred mode of practicing the invention, it will be apparent to those skilled in the art that various modifications and changes can be made therein; which modifications and changes fall within the purview of the inventive concept defined by the appended claims wherein what is claimed is:

1. A fuel burner comprising a hollow cylindrical blast tube; a cylindrical flame tube positioned within and coaxially of said blast tube; annular spacer members supporting said tubes in concentric relation to define an annular elongated air passage between said tubes; at least a pair of fuel atomizing heads positioned at one end of said flame tube and forming the atomizing end of said flame tube and discharging atomized fuel into said flame tube; said atomizing heads including fuel discharge openings disposed so as to discharge atomized fuel in an intersecting path at an included angle of not less than 45° and no more than 150°; igniter means disposed between said atomizing heads and having electrodes positioned out of the path of the atomized fuel discharging from said atomizing heads; a perforated firewall having a central aperture closing said one end of said flame tube, means for admitting air into said flame tube through said central aperture, said igniter being positioned in the center of said aperture, said flame tube having apertures therein at spaced points along its length to emit air in stages into the interior of said flame tube, one of said annular spacer members being imperforate and being disposed adjacent the flame emitting end of said flame tube between said flame tube and said blast tube, the other of said annular spacer member adjacent the atomizing end of said flame tube having perforations therein for the emission of air therethrough.

2. A fuel burner as defined in claim 1 wherein each of said fuel atomizer devices comprises a cup-shaped chamber; a hollow plenum chamber disposed within said cup-shaped chambers; means to discharge the fuel to be vaporized on the exterior of the plenum chamber surface; means to provide combustion air to the interior of the plenum chambers, said plenum chamber having a small aperture therein to discharge the air and the atomized fuel through the mouth of the cup chamber and into said flame tube.

3. A fuel burner as defined in claim 1 wherein said apertures in said flame tube are disposed in diametrically opposed relation, said one pair of said apertures lying at a relative angle of 90° with respect to the other of said pairs of apertures.

4. A fuel burner as defined in claim 3 wherein said one pair of apertures is disposed midway of the length of the flame tube and said other pair of apertures is positioned adjacent the flame emitting end of said flame tube.

5. A fuel burner as defined in claim 4 wherein air is emitted into the elongated annular passage defined between said flame tube and said blast tube and is emitted to the interior of said flame tube through said pairs of apertures.

6. A fuel burner as defined in claim 1 wherein said atomizing heads are carried by said foraminous fire wall and air is emitted to the interior of said flame tube through said central aperture surrounding said igniter and through said perforations.

7. A liquid fuel burner comprising:

a flame tube having an inlet end and an outlet end, first means for admitting air into said inlet end of said flame tube to cause said admitted air to flow in a direction along and parallel to the central axis of said tube, and a plurality of second means located upstream of the outlet end of said flame tube for producing a corresponding plurality of streams of atomized fuel which are angled toward said outlet end and also toward said flame tube central axis so as to intersect substantially at said central axis.

8. The burner of claim 7 which further includes igniter means located upstream of the point of intersection of said fuel streams with the flame tube central axis.

9. The burner of claim 7 which further comprises a transverse wall at said inlet end of said flame tube and said first means includes a central aperture in said wall.

10. The burner of claim 9 in which said wall defines a plurality of small apertures spaced radially outwardly of said central aperture and smaller in size than said central aperture.

11. The burner of claim 9 in which said second means comprises a plurality of fuel atomizing heads, each providing a stream comprising an admixture of fuel and air.

12. The burner of claim 7 which includes further means for admitting additional air into said flame tube at at least one location downstream of said second means.

13. The burner of claim 12 in which said further means causes said additional air to be admitted into said flame tube with a radially inwardly directed velocity component.

14. The burner of claim 12 in which said further means admits air into said flame tube at longitudinally spaced locations along said flame tube.

15. The burner of claim 14 in which said further means includes apertures in the circumferential wall of said flame tube at each of said spaced locations.

16. The burner of claim 15 in which said apertures at the respective successive longitudinally spaced locations are also circumferentially spaced.

17. The burner of claim 11 in which each said fuel atomizing head includes a chamber supporting therein a fuel atomizing means, an air inlet aperture, and an outlet aperture for atomized fuel and air.

18. The burner of claim 12 which further includes a blast tube coaxial with and surrounding said flame tube, said further means including means for admitting air into the annular space between said blast tube and said flame tube for admission into said flame tube.

19. The burner of claim 17 in which each said fuel atomizing means comprises a hollow plenum chamber having a smooth outer surface defining a small through aperture, means for causing the liquid fuel to flow in a thin film over said outer surface and over said aperture, and means for admitting pressurized air into said plenum to exit through said aperture.

20. The burner of claim 18 which further includes a second transverse wall at the downstream end of said blast tube to close off said annular space between said blast tube and said flame tube so as to force air into said flame tube at locations upstream of said second transverse wall.

21. The burner of claim 19 wherein each said outlet aperture opens into a discharge horn means for confining the atomized fuel and air leaving each of said chambers and entering the flame tube.

22. A liquid fuel burner comprising:

a flame tube, means admitting combustion air into said flame tube and for directing said air substantially parallel to the flame tube axis, at least two atomizing heads each positioned to direct atomized fuel along paths which are directed toward each other and into said flame tube and acutely angled relative to the flame tube axis so as to intersect substantially on said flame tube axis, each said atomizing head including a hollow convexly curved plenum chamber with a small aperture therein, means for flowing the fuel over the exterior surface of the chamber in such manner as to produce a thin film of said fuel at the location of said aperture, and means for pressurizing the hollow interior of said chamber.

23. The burner of claim 22 which further includes a blast tube encircling said flame tube so as to define an annular axially elongate air passage between said flame and blast tubes, and a plurality of apertures in said flame tube at staged locations along its axial length to permit the entry of air into said flame tube from said annular air passage.

24. The fuel burner of claim 22 wherein each said atomizing head includes a housing surrounding said plenum chamber, said housing including separate inlet means for the fuel and also for the air to pressurize said plenum chamber and outlet means for the atomized fuel, said housing including further air inlet means permitting a flow of air through said housing to commingle with said atomized fuel.

25. The fuel burner of claim 24 in which each said housing is supported in a chamber which is maintained at a positive static air pressure.

26. The burner of claim 21 wherein said discharge horns are in the shape of truncated cones with their larger diameters affixed to their respective said outlet apertures, said conical horns serving to arrest larger particles in the atomized fuel.

27. The fuel burner of claim 22 in which said atomizing heads are supported on a fire-wall extending transversely of said blast tube and symmetrically disposed relative to the longitudinal central axis of said blast tube, and air inlet means through said fire wall and located substantially on said blast tube axis.

28. The fuel burner of claim 27 in which said fire wall is in the form of a truncated cone with its large diameter disposed towards the downstream end of said flame tube and wherein said air inlet means is axially aligned through said truncated portion of the cone.

29. The burner of claim 28 wherein said truncated cone is perforated to allow additional air to penetrate the wall of said cone.

30. An oil burner sub-assembly for use with a flame tube for admixing finely atomized oil with air for combustion and providing a flame traveling in the flame tube and generally along the longitudinal axis of the flame tube, said sub-assembly comprising:

a plurality of fuel atomizing means, means supporting said plurality of fuel atomizing means each positioned outwardly of said axis and so supported as to direct respective sprays of atomized fuel and air along paths having directional components extending both parallel to and also toward said axis to intersect generally along said axis at a location remote from said supporting means, and means for directing a stream of additional air along said axis in the direction of flame propogation to intersect with the plurality of atomized fuel and air sprays provided by said plurality of fuel atomizing means.

31. The oil burner sub-assembly of claim 30 in which said supporting means defines an aperture for admitting said stream of additional air.

32. The oil burner sub-assembly of claim 30 in which each said atomizing means includes a hollow plenum chamber having a smooth outer surface defining a small through aperture, means for causing the liquid fuel to flow in a thin film over said outer surface and over said aperture, and means for admitting pressurized air into said plenum to exit through said aperture to produce a spray comprising an admixture of fine droplets of oil and air.

33. The oil burner sub-assembly of claim 32 in which further means associated with each said fuel atomizing means directs a stream of secondary air to flow with and in the same direction as the spray of finely atomized fuel and air produced by the respective fuel atomizing means.

* * * * *